United States Patent [19]

Negoro et al.

[11] Patent Number: 5,001,733

[45] Date of Patent: Mar. 19, 1991

[54] RESET MECHANISM FOR PHOTOCONDUCTIVE DRUM

[75] Inventors: Ikuo Negoro, Sakado; Masahiro Kita, Tokyo, both of Japan

[73] Assignee: Asahi Kogaku Kogyo Kabushiki Kaisha, Tokyo, Japan

[21] Appl. No.: 374,073

[22] Filed: Jun. 30, 1989

[30] Foreign Application Priority Data

Jul. 1, 1988 [JP] Japan ..... 63-87656[U]
May 19, 1989 [JP] Japan ..... 1-57776[U]

[51] Int. Cl.[5] ..... G06M 1/28

[52] U.S. Cl. ..... 377/88; 355/211; 355/308

[58] Field of Search ..... 377/88; 355/211, 308

[56] References Cited

U.S. PATENT DOCUMENTS

| | | | |
|---|---|---|---|
| 3,648,028 | 3/1972 | Hara et al. | 377/88 |
| 3,700,163 | 10/1972 | Soden | 377/88 |
| 4,264,806 | 4/1981 | Kubler | 377/88 |
| 4,506,373 | 3/1985 | Kratt | 377/88 |
| 4,551,000 | 11/1985 | Kanemitsu et al. | 355/210 |
| 4,585,327 | 4/1986 | Suzuki | 355/211 |
| 4,775,781 | 10/1988 | Fukunaga et al. | 355/308 |

FOREIGN PATENT DOCUMENTS

| | | |
|---|---|---|
| 60-32065 | 2/1985 | Japan . |
| 61-83570 | 4/1986 | Japan . |

*Primary Examiner*—John S. Heyman
*Attorney, Agent, or Firm*—Sandler, Greenblum & Bernstein

[57] ABSTRACT

In a reset mechanism for resetting a counter counting the number of rotations of a photoconductive drum which is employed in a laser beam printer and the like, rocking member is provided to be rocked only when the photoconductive drum is primarily rotated and means for resetting the counter in response to the rocking movement of the rocking member. Thus, the counter is accurately reset in case that a new photoconductive drum is installed in the printer and the photoconductive drum is primarily rotated.

9 Claims, 5 Drawing Sheets

RESET MECHANISM FOR PHOTOCONDUCTIVE DRUM

BACKGROUND OF THE INVENTION

This invention relates to a reset mechanism of a counter for counting the number of revolutions of a photoconductive drum provided on a printer for forming visible images on a recording sheet, more particularly, to a reset mechanism capable of resetting the counter only when a new photoconductive drum is installed on the printer.

Laser printers are recently coming into wide use and compact inexpensive printers utilizing semiconductor lasers in particular are increasingly being put to practical use. A laster printer of that sort has been so contrived as to obtain hard copies of image data on a recording sheet by means of the so-called electrophotographic duplicating processes including exposing process for exposing a photoconductive drum charged with electricity to a laser beam modulated according to image data on graphs as well as characters and subsequently passing the resulting latent images through a developing process for forming a visible image on the surface of the photoconductive drum. A transferring process for transferring the visible image to a recording sheet, a fixing process for fixing the transferred image on the recording sheet by pressurizing the recording sheet with the heat, and the like.

In such a laser printer constructed as an electrophotographic imaging device, the photoconductive drum wears out through in small increments as it undergoes each step of the electrophotographic duplicating processes, e.g., transfer or cleaning of the surface of the photoconductive drum. If the photoconductive drum has become worn, it will become poorly charged or allow the presence of an after-image on its surface. This will also cause bad setting, i.e. inadequate transfer to recording sheet, etc.

Consequently, the photoconductive drum is formed into a unit so that it can simply be replaced and equipped with a counter for counting pulse signals which are synchronized with revolution of the photoconductive drum to use the count for determining the timing at which the photoconductive drum is to be replaced.

In other words, the photoconductive drum is replaced at the point of time that the count indicated by the counter has reached a predetermined value, i.e., a predetermined number of recording sheets have been printed. The counter is cleared when the photoconductive drum is replaced. There is provided a microswitch, for instance, for detecting the presence or absence of the photoconductive drum and the counter is reset using presence-absence-presence signals applied from by the microswitch when the photoconductive drum is replaced.

However, since the power supply of the printer is turned off when the photoconductive drum is replaced, the microswitch will not be actuated and consequently the counter cannot be reset. In other words, the counter will advance to the existing count prior to the replacement and start counting again. The counter will otherwise be reset despite the face that the photoconductive drum is reinstalled after it is removed once for maintenance, inspection and the like.

A known arrangement to meet the aforementioned problems is to provide the photoconductive drum unit with a pin abutting against the microswitch for detecting the presence or absence of the photoconductive drum in such a manner as to make the pin break immediately after it has come in contact with the microswitch simultaneously when the unit including the photoconductive drum is installed. Since the pin is broken at the time the unit is initially mounted, the counter is prevented from being reset when the photoconductive drum is reinstalled after it has been once removed.

However, the counter is not reset while the power supply of the printer itself it turned off as in the preceding case where such a pin is not employed; the problem, in this case, remains i.e. a mounting of a new photoconductive drum is undetected.

SUMMARY OF THE INVENTION

It is therefore an object of the invention to provide an improved reset mechanism for a photoconductive drum counter to ensure that the counter for counting the number of revolutions of a photoconductive drum is reset only when the photoconductive drum is replaced.

For this purpose, according to the invention, there is provided a reset mechanism employing a counter for counting the number of rotations of a rotary member, said reset mechianism comprises:

an irreversible rocking member, being biased in a predetermined direction, capable of being rocked only in said predetermined direction; and control means for controlling said counter so as to be reset in case that said rocking member is rocked.

with this arrangement, the rocking member operates the control means when a new photoconductive drum is installed, so that the counter can be reset using the output signal of the control means at the time the power supply intended for the whole printer is turned on and the photoconductive drum is initially rotated. In other words, the counter can be reset whenever a new photoconductive drum is installed and therefore prevented from being reset when the photoconductive drum is detached therefrom for the purpose of maintenance to ensure that the counter is reset only when the photoconductive drum is replaced.

DESCRIPTION OF THE ACCOMPANYING DRAWINGS

Figure 9A:
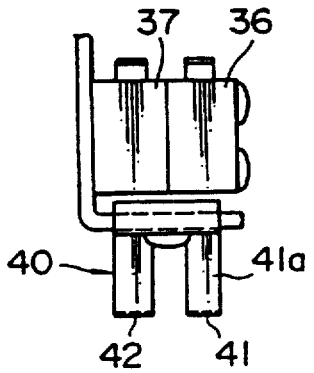
Figure 9B:
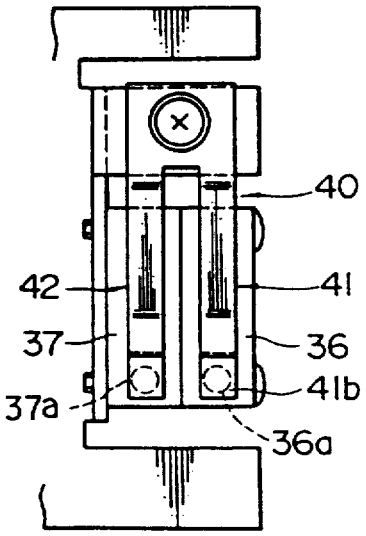

FIGS. 9(A) and 9(B) are top and elevational views illustrating microswitch layouts included in the reset mechanism according to the present invention.

DESCRIPTION OF THE EMBODIMENTS

Figure 1:
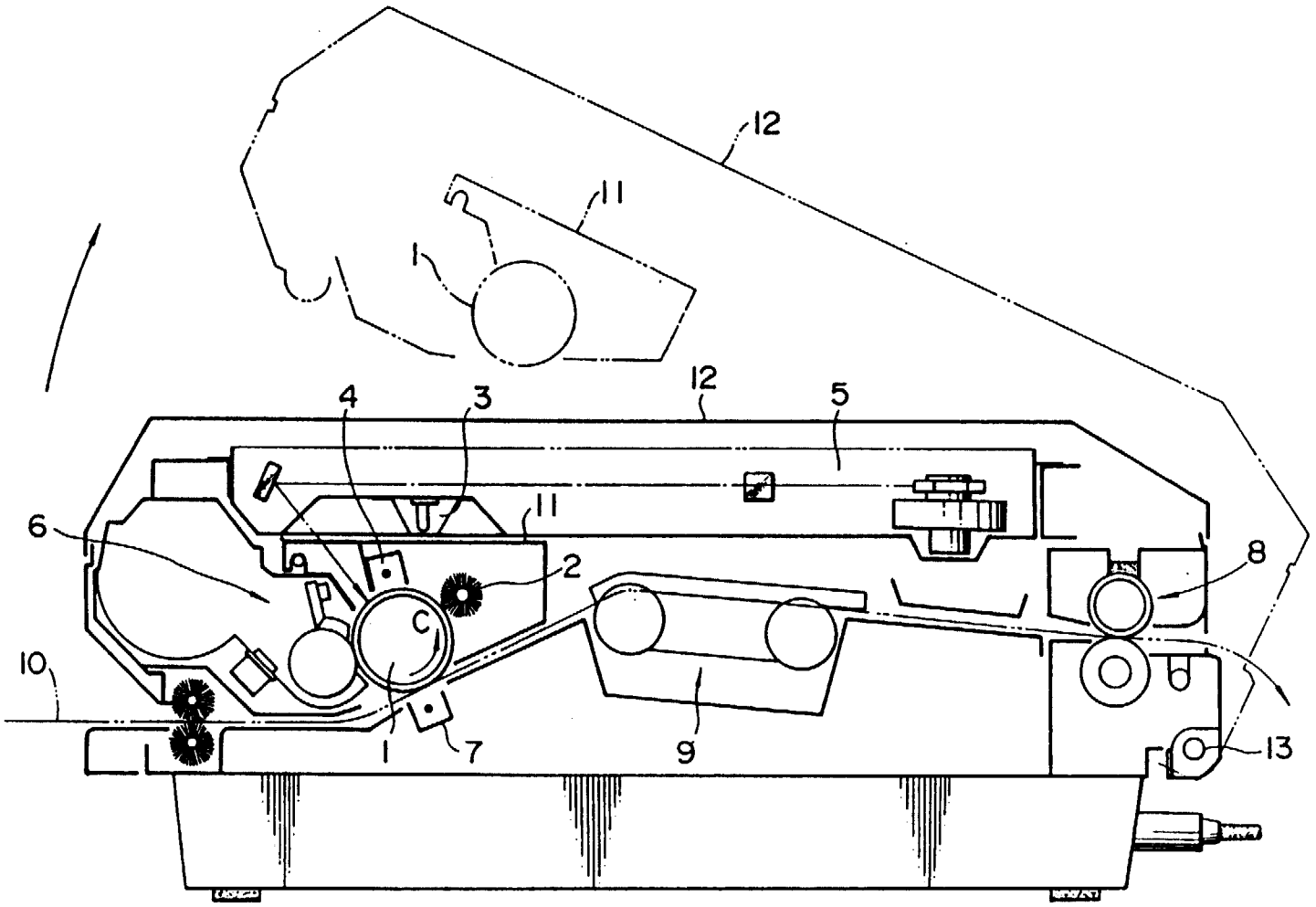
FIG. 1 is a schematic side view of a laser printer having a reset mechanism for a photoconductive drum counter according to one embodiment of the present invention.

FIG. 1 is a schematic side view of a laser printer having a reset mechanism for a photoconductive drum counter according to embodiment of the present invention.

This laser printer is designed to print data received from a host computer or the like on a fan-folded form 10 by electrophotography and to deliver the printed paper.

A toner-cleaning station 2, a de-charging station 3 a charging staton 4, an optical scanning system 5 leading to a photoconductive drum 1, a laser beam modulated according to input data, a developing station 6, and a transferring station 7 are adequately disposed in the above order along the direction of rotation of the photoconductive drum 1. A fixing station 8 is disposed in a predetermined fore part in the direction of movement of the fan-folded form 10, whereas a guide mechanism 9 for carrying and guiding the fan-folded form 10 in a predetermined direction is properly disposed in the path of the fan-folded form 10 from the drum 1 to the fixing station 8, the guide mechanism 9 being simultaneously used to regulate the fan-folded form 10 moderately by applying resisting force to both ends thereof.

The surface of the photoconductive drum 1 is scanned by the laser beam emitted from the optical scanning system 5 in the longitudinal direction thereof (main scanning). While the main scanning is repeated, the photoconductive drum 1 is rotated in direction of an arrow "C" so that the surface thereof is scanned in the direction oposite to the direction of rotation thereof (auxiliary scanning). A latent image is accordingly formed on the surface of the photoconductive drum 1 by the laser beam and the latent image is formed into a toner image by the developing station 6. In other words, the latent image thus formed is developed into a visible image through the electrophotographic process. The toner image is transferred from the surface of the photoconductive drum 1 onto that of the fan-folded form from 10 by the transfer station 7 and the toner image thus transferred is fixed by the fixing station 8. The fan-folded form 10 is then discharged from the laser printer.

The photoconductive drum 1 is installed in a sub-shell 11 as a support member in such a manner that both ends htereof are supported thereby and a simply replaceable unit is formed with the sub-shell. More specifically, the sub-shell 11 used to support the photoconductive drum 1 is detachably fitted to a predetermined region of a clamshell 12 which forms an upper cover of the laser printer and, when the sub-shell 11 is fixed in position, the photoconductive drum 1 is disposed as arranged relative to each element of the electrophotographic processing such as the developing station 6, the transferring station 7 and the like. The sub-shell 11 is readily detachable as the clamshell 12 is turned around a pivot shaft 13 and opened.

Although the toner-cleaning station 2 and the charging station 4 are located in the sub-shell 11, they are anchored thereto and therefore not detachable from the clamshell 12 in a manner similar of the detachment of the sub-shell 11.

Figure 2:
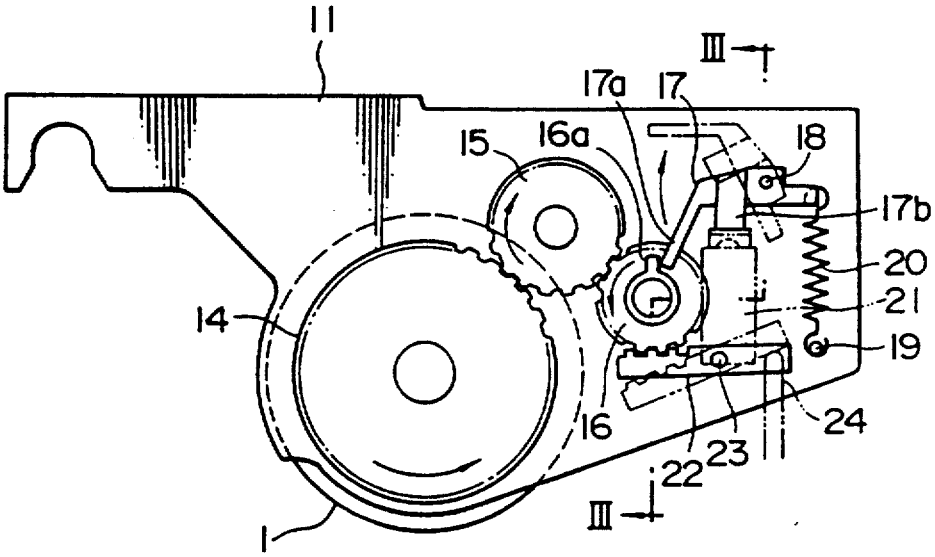
FIG. 2 is an enlarged side view illustrating a part of a sub-shell provided on the printer of FIG. 1.
Figure 3:
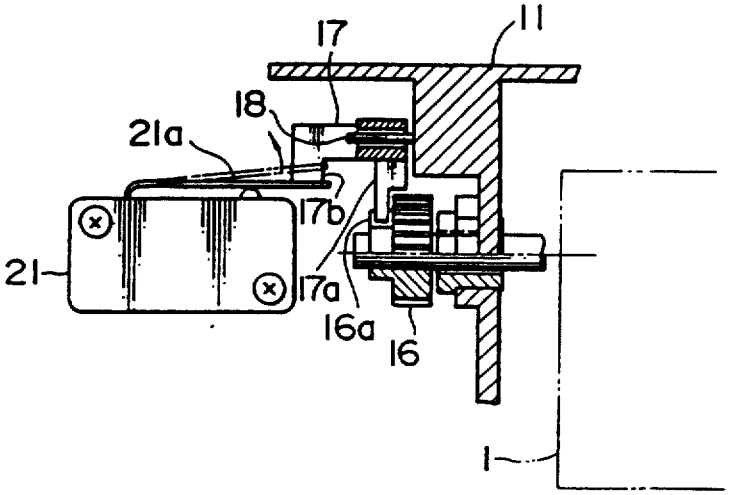
FIG. 3 is a sectional view taken along a line III—III of FIG. 2.

FIG. 2 is an enlarged side view illustrating part of the sub-shell 11 of FIG. 1 in detail. FIG. 3 is a sectional view taken along a line III—III of FIG. 2.

A gear 14 is coaxially fitted to one end of the photoconductive drum 1 having both ends supported with the sub-shell 11, whereas a gear 15, a gear 16 and a doglegged lever 17 are properly disposed in the sub-shell 11 therearound. In other words, the gear 14 meshes with the gear 15, which alternatively meshes with the gear 16 as a rotary member interlocked with the rotation of the photoconductive drum 1. The lever 17 is rotatably supported by a pivot shaft 18 perpendicularly fitted ot the sub-shell 11 and the perpendicular position of the pivot shaft 18 is regulated so that the extended, substantially doglegged end portion **17*a* of the lever 17 and a protrusion 16*a* formed in part of the rotary shaft of the gear 16** may abut against each other.

The other end of the lever 17, i.e., what is opposite to the end portion **17*a* about the shaft 18 is coupled to a pin 19 extending perpendicularly to the sub-shell 11, and a spring 20 acting as a bias member is provided between pin 19 and the end of lever 17 as shown in FIG. 2. Thus, the lever 17 is biased by the tensile force of the spring 20 toward the pin 19. The end portion 17*a* of the lever 17 is accordingly biased as to revolve clockwise around the pivot shaft 18. A projection 17*b* is formed on the end portion side 17*a* of lever 17 and used to press the switch lever 21*a* of a microswitch 21**, which will be described later.

The gear 16 meshes with a rotatable lever 22 disposed close thereto and the rotation of the gear 16 is retained to the extent the lever 22 is allowed to mesh therewith. In other words, the lever 22 has one end used as a rack and is rotatably suported by a pivot shaft 23 perpendicularly fitted to the sub-shell 11, the rack portion thereof being biased by the force of a spring (not shown) in the direciton in which it abuts against the gear 16. The rack portion of the lever 22 is thereby made to engage with and control the gear 16.

More specifically, the lever 22 serves as a lock mechanism for locking the rotation of the photoconductive drum 1, whereby the rotation of the photoconductive drum 1 is interlocked with that of the gear 16. The locking operation implemented by the engagement of the rack portion of the layer 22 with the gear 16 is released by a pin 24 perpendicularly fitted to a predetermined position of the laser printer body when the clamshell 12 is closed. That is, the toothless end portion of the lever 22 comes in contact with the pin 24 when the clamshell 12 is closed and is the end portion forced to move up, so that the rack portion of the lever 22 is rotated and separated from the gear 16.

Both the photoconductive drum 1 and the sub-shell 11 supporting the photoconductive drum 1 are replaced together; in other words, the sub-shell 11 is replaced while the clamshell 12 is kept open after it has pivoted about the pivot shaft 13. A new sub-shell 11 as a substitute for the old one is recharged with a new photoconductive drum 1 and initially set in such a state that the protrusion **16*a* of the gear 16 retains the end portion 17*a* of the lever 17 rotatably biased clockwise by the spring 20. The initial state of the lever 17 is hereinafter understood as one where the protrusion 16*a* of the gear 16 keeps the end portion 17*a* of the lever 17** retained.

The initial state of the lever 17, i.e., the state in which the protrusion **16*a* of the gear 16 makes contact with the end portion 17*a* of the lever 17 is released by a rotation of theh photoconductive drum 1. Since the gear 16 is caused to rotate counterclockwise via the gear 15 correspondingly in response to the counterclockwise rotation of the photoconductive drum 1, the protrusion 16*a* of the gear 16 slips off the end portion 17*a* of the levwer 17** so that the initial state is released.

The microswitch 21 is secured at a predetermined position of the printer body facing the clamshell 12. When the lever 17 on the sub-shell 11 is in the initial state, the microswitch 21 is fixed to a position where its switch lever 21*a* is pressed by the projection 17*b* of the lever 17. The microswitch 21 is designed to detect whether the switch lever 21*a* is pressed by the projection 17*b* of the lever 17, i.e., whether the lever 17 is in the initial state or not. When the switch lever 21 is freed of the pressure force applied by the projection 17*b* of the lever, i.e., when the lever 17 is released from the initial state, the microswitch 21 outputs a detection signal to that effect.

The microswitch 21 is electriclaly connected to a photoconductive drum counter, not shown, for counting the pulse signal synchronized with the rotation of the photoconductive drum 1 and the detection signal is received by the photoconductive drum counter as a reset signal. The resetting of the photoconductive drum counter on the basis of the detection signal is effected on condition that the photoconductive drum counter is reset by the detection signal supplied from the microswitch 21 only when the clamshell 12 remains closed. When the clamshell 12 is left open, the photoconductive drum counter will not be reset. In other words, the power supply of the laser printer is not turned on while the clamshell 12 is left open and the photoconductive drum counter will not be reset however often the microswitch 21 may produce the detection signal.

With this arrangment, the photoconductive drum counter is reset upon receipt of the detection signal from the microswitch 21 only when the photoconductive drum 1 is rotated after the clamshell 12 is closed to turn on the power supply while the lever 17 in the sub-shell 11 remains in the initial state (i.e., the photoconductive drum 1 fitted to the sub-shell 11 has to be new). When the sub-shell 11 equipped with the photoconductive drum 1 is installed again after it is removed for the inspection of the photoconductive drum 1, the photoconductive drum counter is prevented from being wrongly reset since the lever 17 has been already released from the initial state. Thus, the photoconductive drum counter is reset with certainty only when the photoconductive drum 1 is replaced.

Figure 4:
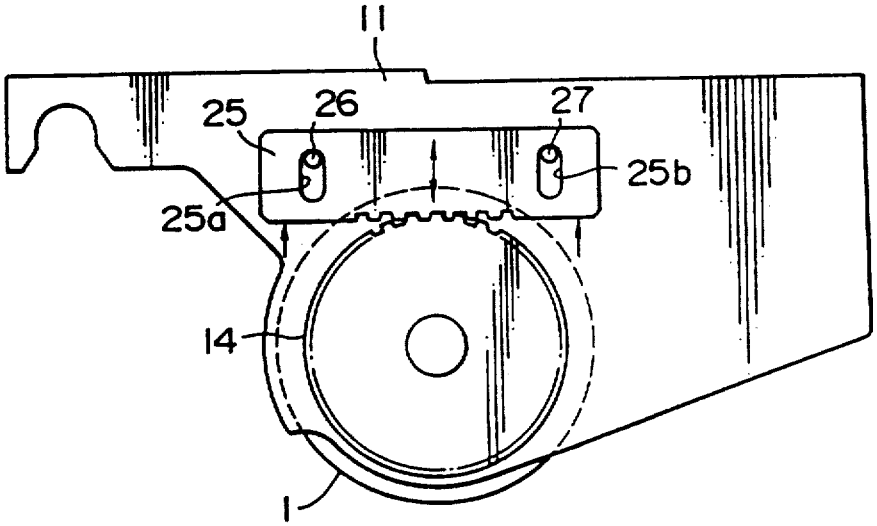
FIG. 4 is a side view of a one example of a lock mechanism of the phoitoconductive drum.

Although the lock mechanism has the rack portion of the lever 22 meshed with the gear 16 to stop the photoconductive drum 1 from rotating, the present invention is not limited to this arrangement but applicable in any other way as the occasion may demand; e.g., one side of a rectangular plate 25 may be toothed as shown in FIG. 4 to mesh with the gear 14. In the lock mechanism shown in FIG. 4, slits 25*a*, 25*b* are formed in the plate 25 and pins 26, 27 perpendicularly fitted to the sub-shell 11 are slidably fitted into the slits 25*a*, 25*b*, whereas the plate 25 is bised by a spring, not shown, and by its own weight toward the gear 14, so that the gear 14 is prevented rotating when it meshes with the rack portion of the plate 25. The rack portion of the plate 25 is released from meshing with the gear 14 when the plate 25 is forced to move up by a pin, not shown, similar to the pin 24.

Referring to FIG. 5 to 9, a second embodiment of the present invention will now be described, wherein like reference numbers designate like components shown in the first embodiment.

A laser printer in the second embodiment is arranged so that the sub-shell 11 supporting the photoconductive drum 1 is mounted on the laser printer body side and the open-close type clamshell presses the sub-shell 11 when it is closed so as to hold the subshell 11 in position. When the clamshell is opened, the photoconductive drum 1 is easily replaceable.

The drum gear 14 formed on the periphery of the photoconductive drum 1 and a cleaner drive gear 31 for driving a cleaning device are revealed at one side end of the sub-shell 11. When the sub-shell 11 is mounted on the laser printer body, the gears 14, 31 mesh with a drive gear, not shown, disposed on the laser printer body side to make the rotation force of the photoconductive drum 1 transmitable.

An idle gear 32 as a rotary member interlocked with the rotation of the photoconductive drum 1 meshes with the cleaner drive gear 31, whereas gear 33, 34 respectively fitted to a cleaner brush and a recovery roller mesh with the idle gear 32 to rotate the cleaner brush and the recovery roller via the idle gear 32 in response to a rotation of the cleaner drive gear 31. The cleaner drive gear 31 is geared to the drum gear 14 and driven to rotate invariably when the photoconductive drum 1 is rotated. Further the cleaner brush and the recovery roller both are mechanically connected to the drive gear 31 and are thus driven to rotate thereby.

Figure 5:
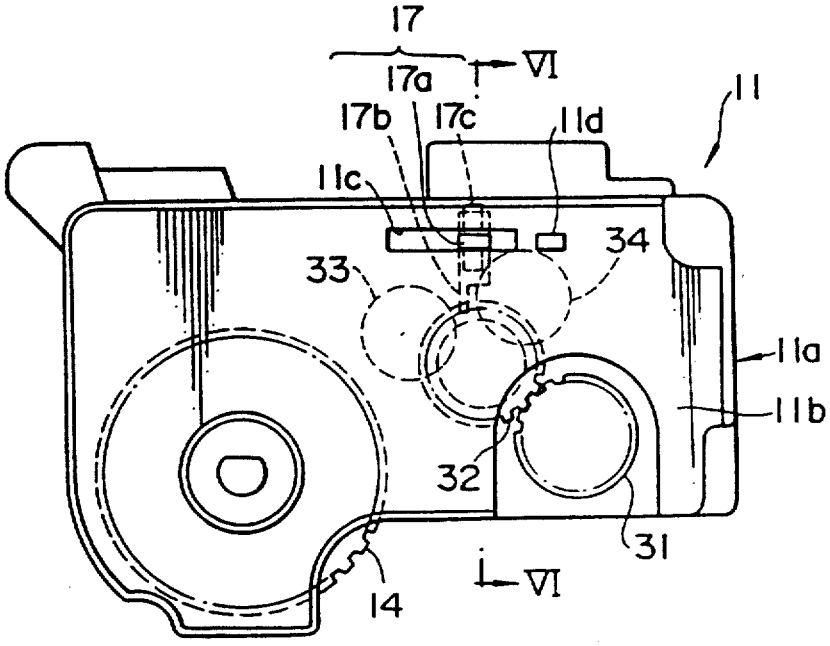
FIG. 5 is a side view of a sub-shell incorporating the reset mechanism according to another embodiment of the present invention.
Figure 6:
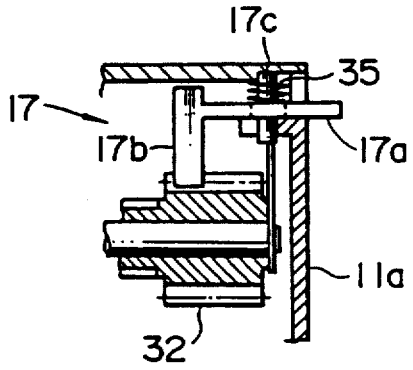
FIG. 6 is a sectional veiw taken along a line VI—VI of FIG. 5.

The lever 17 as a lever member is pivotally supported with the case 11*a* of the sub-shell 11 in such a manner as to be capable of horizontally rocking above the idle gear 32 as shown in FIG. 6, which is a sectional view taken along a line VI—VI of FIG. 5.

The lever 17 has a retaining part 17*b* at one end of a horizontal lever portion 17*a*, the retaining part 17*b* extending in a vertical direction. A shaft 17*c* protrudes upward and downward substantially in the center of the lever portion 17*a* and made rotatably by the shaft 17*c* in the case 11*a*. A torsion spring 35 acting as a bias means is externally fitted to the upper side of the shaft 17*c* and used to bias the lever 17 in a direction in which the retaining part 17*b* is separated from the idle gear 32.

Figure 7:
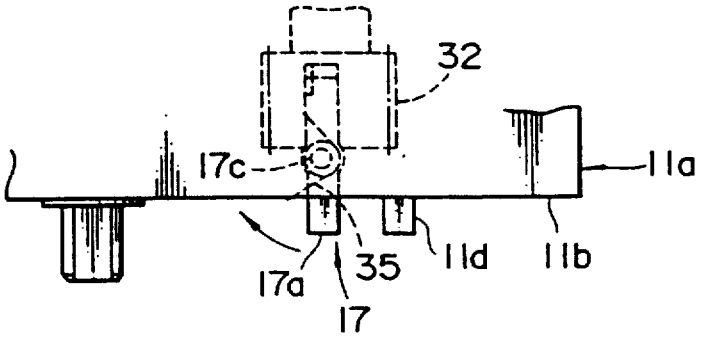
FIG. 7 is a plane view of the sub-shell illustrated in FIG. 5.

The relative position of the lever 17 is set up so that, when the retainer part 17*b* is revolved in a direction close to the idle gear 32, the lowermost end of the retaining part 17*b* interferes with the addendum but not bottom of the idle gear 32. The retaining part 17*b* is thus made revolvable up to a position closest to the idle gear 32 when the lowermost end of the retaining part 17*b* is inserted between the teeth of the idle gear 32. When the retaining part 17*b* has moved closest to the idle gear 32, moreover, the lever portion 17*a* as shown in FIG. 7, is substantially vertically positioned the required amount relative to a side case plate 11*b* out of a slit 11*c* provided with the case plate 11*b*.

The side case plate 11*b* of the sub-shell 11 is provided with an operating protrusion 11*d* adjacent to the protruded lever portion 17*a*.

In the laser printer thus constructed, the photoconductive drum 1, together with the sub-shell 11, is replaced. With a new photoconductive drum 1, the retaining part 17*b* is revolved in a direction in which it moves close to the idle gear 32 while resisting the bias force of the torsion spring 35 and set in such a state that the retaining part 17*b* is held in between the teeth of the idle gear 32 and retained therein. In other words, the sub-shell 11 of the new photoconductive drum 1 is arranged in such a manner that the lever portion 17*a* of the lever 17 extends from the side case plate 11*b*. The revolving force of the lever 17 biased by the torsion spring 35 is set insufficient to drive and rotate the idle gear 32 and the cleaning station 4 connected to the idle gear 32.

A microswitch 36 as a switch is disposed in a position corresponding to the position where the lever 17 is located on the sub-shell 11. The lever portion 17*a* protruded from the side case plate 11*b* is caused to press the microswitch 36.

Figure 8:
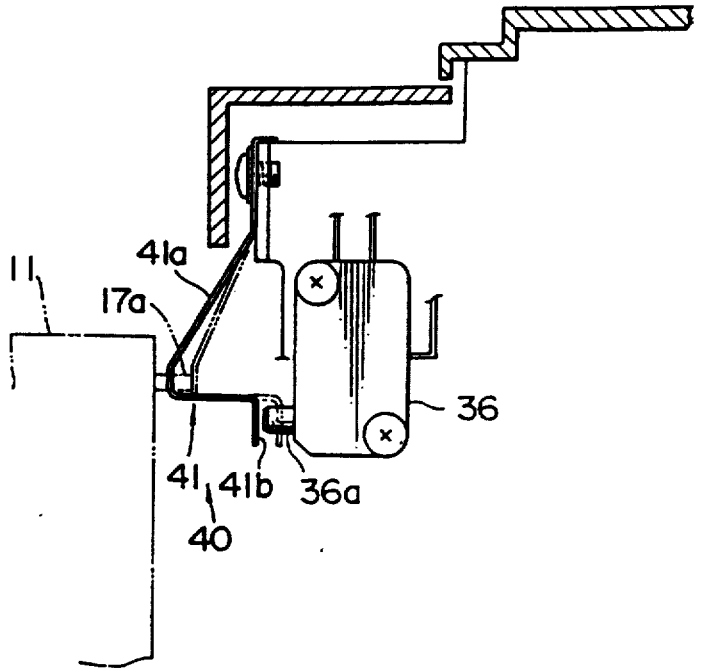
FIG. 8 is a partial top view of the sub-shell of FIG. 5.

As shown in FIG. 8 and 9, an operating arm 41 having an inclined elastic portion 41*a* which is movable close to a side surface of the sub-shell 11 and an operating presser portion 41*b* formed with the lower end outwardly bent is disposed in a position corresponding to the lever portion 17 *a* extending from the side case plate 11*b*, whereas the microswitch 36 is disposed in such a manner that a switch button 36*a* corresponds in postion to the operating presser position 41*b* of the operating arm 41. The operating arm 41 is normally set free from pressing the switch button 36*a* of the microswitch 36. When the sub-shell 11 is mounted on the laser printer body, the lever portion 17*a* protruded from the side case plate 11*b* of the sub-shell 11 abuts against the inclined portion 41*a*, thus causing elastic deformation thereto, and thereby the switch button 36*a* is pressed by the operating presser portion 41*b*.

The operating arm 41 is formed as a part of an operating element 40, which is fitted with an operating arm 42 similar in shape to the operating arm 41 and disposed in parallel to and a predetermined space apart from the operating arm 41. A microswitch 37 fixedly secured to the microswitch 36 is disposed in a position corresponding to the operating arm 42.

The operating arm 42 corresponds to the operating protrusion 11*d* protruded from the side case plate 11*b* of the sub-shell 11 and adjacent to the lever portion 17*a* and is caused to press a switch button 37*a* provided on the microswitch 37 whenever the sub-shell 11 is fitted in the laser printer body.

In the laser printer thus constructed, the lever portion 17*a* and the operating protrusion 11*d*, each protruding from the side case plate 11*b*, are made to press the microswitches 36, 37 via the respective operating arms 41, 42 when the sub-shell of a new photoconductive drum 1 is mounted on the laser printer body. In this state, it is primarily detected that the sub-shell 11 is mounted on the printer body by means of a signal from the microswitch 37. When the power supply is turned onto start operation, the photoconductive drum counter, on receiving the signal from the microswitch 36, is reset. When the idle gear 32, is interlocked with the rotation of the photoconductive drum 1 as described above, and driven to rotate after the operation is started, the retaining part 17*b* of the lever 17 slips off the gap between the teeth of the idle gear 32 as it rotates. As a result, the retaining part 17*b* is caused by the energizing force of the torsion spring 35 to rock and revolve away from the idle gear 32, whereas the lever portion 17*a* is withdrawn through the slit 11*c* into the side case plate 11*b*. The microswitch 36 is thus released from being pressed.

Once the photoconductive drum 1 is actuated, the lever portion 17*a* thus protruded retracts and no longer presses the switch button 36*a* of microswitch 36. Therefore, the photoconductive drum counter will not be reset even if the sub-shell 11 is detached for maintenance and the like.

On the other hand, the other microswitch 37 is pressed and operated whenever the sub-shell 11 is fitted into the printer and the presence or absence of the sub-shell 11 is detected by the output signal of the microswitch 37. In other words, the output signal from the microswitch 37 is used to determine operability of the printer.

What is claimed is:

1. A reset mechanism employed on a counter for counting the number rotations of a rotary member, said reset mechanism comprising:

a rocking member biased in a predetermined direction, capable of being rocked only once in said predetermined direction; and control means for controlling said counter so as to be reset when said rocking member is rocked, said control means comprising a stopping member provided on a further rotary member rotating in response to rotation of said rotary member for stopping a rocking operation of said rocking member.

2. The reset mechanism according to claim 1 wherein said rotary member is a photoconductive drum employed in a printer, said photoconductive drum being exposed to light to form a latent image on the circumferential surface thereof.

3. The reset mechanism according to claim 1 wherein said stopping member comprises a contact element arranged to be brought into contact with a predetermined portion of said rocking member for stopping a rocking operation against the bias force applied to said rocking member and a switch member for resetting said counter when said contact element and said predetermined portion are brought out of contact by means of a rocking operation of said rocking member.

4. The result mechanism according to claim 3 wherein said rocking member comprises a lever member revolvable about a shaft in said predetermined direction by the bias force applied by a spring member connected to one end of said lever member and said contact element comprises a projection portion provided on a shaft of said further rotary member.

5. The reset mechanism according to claim 3 wherein said rocking member comprises a lever horizontally movable about a shaft in said predetermined direction by the bias force applied by a torsion spring member wound about said shaft and said predetermined portion is a projection provided on said lever member and said contact element comprises a tooth portion of an idle gear positioned to be brought into contact with said projection portion of said lever member, said idle gear rotatable in response to a rotation of said rotary member.

6. A reset mechanism employed on a counter for connecting the number of rotations of a photoconductive drum exposed to light to form a latent image on the circumferential surface of said drum, said reset mechanism comprising:

a lever member biased in a predetermined direction and capable of being moved only once in said predetermined direction;

a stopping member providing on a rotary member rotating in response to rotation of said photoconductive drum, for stopping movement of said lever member in a said predetermined direction; and a switch member for resetting said counter when the stopping of said lever member by said stopping member is released by rotation of said rotary member, and movement of said lever member is executed by bias force.

7. The reset mechanism according to claim 6 wherein said stopping member comprises a contact element arranged to be brought into contact with a predetermined portion of said lever member.

8. The reset mechanism according to claim 7 wherein said contact element comprises a projection portion provided on a shaft of said rotary member.

9. A reset mechanism employed on a counter for counting the number of rotations of a rotary member, said reset mechanism comprising:

a lever element, arranged to be rockably movable only once from a first position to a second position about a shaft member and to be biased towards said second position, for resetting said counter when said lever member is located at said second postion;

stopping means for stopping said lever member at said first position; and releasing means for releasing the stopping of said lever member at said first position by said stopping means in accordance with rotation of said rotary member, whereby said counter is reset by movement of said lever member from said first position to said second position after said stopping means is released by said releasing means.

* * * * *

UNITED STATES PATENT AND TRADEMARK OFFICE

CERTIFICATE OF CORRECTION

PATENT NO. : 5,001,733

DATED : March 19, 1991

INVENTOR(S) : Ikuo NEGORO et al.

It is certified that error appears in the above-indentified patent and that said Letters Patent is hereby corrected as shown below:

At column 8, line 30 (claim 4, line 1), change "result" to ---reset---.

At column 8, line 42 (claim 5, line 6), insert ---portion--- after "projection".

At column 8, line 49 (claim 6, line 2), change "connecting" to ---counting---.

At column 10, line 2 (claim 9, line 8), change "postion" to ---position---.

Signed and Sealed this

Sixteenth Day of May, 1995

*Attest:*

*Attesting Officer*

Bruce Lehman

BRUCE LEHMAN

*Commissioner of Patents and Trademarks*